United States Patent [19]

Reeves

[11] 3,964,708

[45] June 22, 1976

[54] HAIR DRYER CRADLE

[75] Inventor: Michael G. Reeves, Scottsdale, Ariz.

[73] Assignee: Gloria J. Reeves, Phoenix, Ariz.

[22] Filed: Mar. 14, 1975

[21] Appl. No.: 558,212

[52] U.S. Cl. ..... 248/126; 211/89; 248/314

[51] Int. Cl.[2] ..... A47F 5/08

[58] Field of Search ..... 248/126, 121, 310, 311, 248/309, 314, 315, 127, 146, 152, 154, 205 R, 207, 346, 350, 359, 360, 12, 13, 14, 15–20, 25; 211/89, 60, 87, 62, 69, 69.1, 69.2–69.9, 71, 74, 75, 79

[56] References Cited

UNITED STATES PATENTS

| | | | |
|---|---|---|---|
| 2,696,370 | 12/1954 | Gafford | 248/311 X |
| 2,773,663 | 12/1956 | Beers | 248/314 |
| 3,185,291 | 5/1965 | Lerner | 248/346 X |
| 3,306,566 | 2/1967 | Paulson et al. | 248/350 |
| 3,499,626 | 3/1970 | Barker | 248/314 |

FOREIGN PATENTS OR APPLICATIONS

| | | | |
|---|---|---|---|
| 256,169 | 12/1964 | Australia | 248/314 |

*Primary Examiner*—Roy D. Frazier
*Assistant Examiner*—Terrell P. Lewis
*Attorney, Agent, or Firm*—Warren F. B. Lindsley

[57] ABSTRACT

A cradle for a hand held hair dryer or curling iron, the cradle comprising a cylindrical chamber which receives the nozzle of the blower and a concave cavity which surrounds a part of the motor housing of the dryer blower. The chamber and cavity structure is removable from the supporting base of the cradle with provision to allow its installation at either of two positions thereby facilitating the mounting of the supporting base on a horizontal or a vertical surface.

5 Claims, 9 Drawing Figures

HAIR DRYER CRADLE

BACKGROUND OF THE INVENTION

Professional hair dressers need a convenient place for stowing hand held hair dryers, hot curling irons and other similar appliances between periods of use. Such appliances are ordinarily provided with pierced hanging tabs or hooks, but the operator is usually in a hurry and has no time to exercise the careful effort required to use this type of mounting structure.

Because of the lack of a convenient means for stowing such appliances, the operators simply place them on the top of a nearby shelf or table, thereby subjecting the appliance to the possibility of being bumped or pulled off of the table as the operator trips over its cord. The appliance may then fall to the floor, break and be rendered inoperative or unsafe for further use. Because no definite place is provided for stowing the appliance, the operator also loses time, first in finding a place for it and later in looking and reaching for it again.

In the interests of saving time, preventing damage to the appliances and reducing financial loss and safety hazards, a more convenient means is needed for stowing hand held hair dryers, curling irons and the like between periods of use.

SUMMARY OF THE INVENTION

Therefore, in accordance with the invention claimed, a special cradle is provided for holding hand held hair dryers during periods of non-use. The cradle is convertible for table top or wall mounting and is also adapted for holding other appliances such as hot curling irons.

It is, therefore, one object of this invention to provide a new and improved cradle for holding a hand held electric hair dryer between periods of use.

Another object of this invention is to provide a cradle which is appropriately shaped to facilitate the quick and effortless insertion of hair dryers or other appliances.

A further object of this invention is to provide a cradle which holds hair dryers or other appliances securely in position and facilitates their quick and easy retrieval for subsequent use.

A still further object of this invention is to provide a cradle in a form which is readily attachable to a vertically or horizontally mounting surface in a manner which prevents the cradle from becoming dislodged and falling to the floor.

A still further object of this invention is to provide such a cradle in a form which is readily mountable on a horizontal or a vertical surface.

A still further object of the invention is to provie such a cradle in a compact form which requires a minimum of mounting space on the wall, shelf, or table top.

Yet another object of the invention is to provide such a cradle which may be readily and economically formed from a plastic material.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
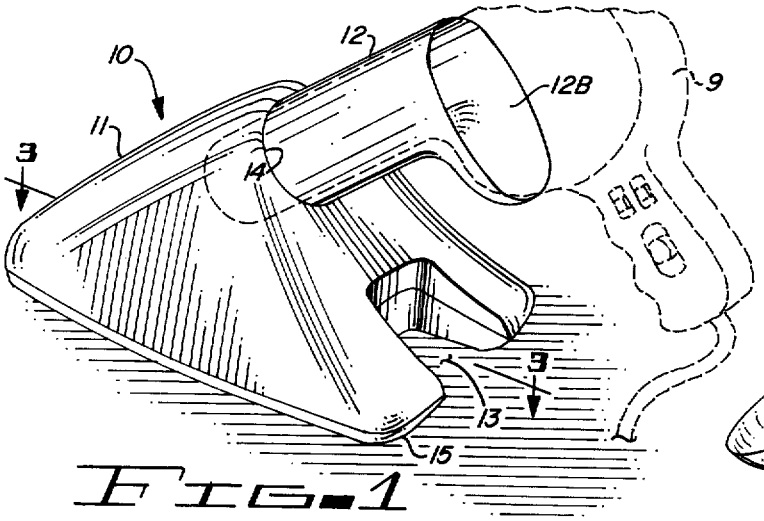
FIG. 1 is a perspective view of a cradle mounted on a horizontal surface with a dash line image shown of a hand held hair dryer supported therein.

Referring more particularly to the drawing by characters of reference, FIGS. 1–6 disclose a cradle 10 for stowing a hand held electric hair dryer 9 between periods of use, the cradle 10 comprising a base 11 and a removable cylindrical chamber 12.

Base 11 is in the general shape of the base of an ordinary table model telephone set with the exception that it is somewhat narrower, tapering slightly to a narrower width at its rear, as shown. An opening 13 is provided at the center of its front edge. Base 11 has a pyramidal outline with a circular opening 14 provided near the top of its front face dimensioned to receive the cylindrical chamber 12.

Base 11 has a removable bottom cover 15, the edges of which flare laterally from the base about its periphery in a common direction. Projecting inwardly from the inside surface of cover 15 are two longitudinal stiffening fins 16A and 16B, two lateral stiffening fins 17A and 17B, the first fin 17A joining the rearward extremities of fins 16A and 16B and the second fin 17B crossing fins 16A and 16B near their centers, and two clips 19A and 19B located at the right and left extremities of fin 17B, as shown in FIG. 1. The clips 19A and 19B have outwardly extending ridges at their extremities for gripping mating inwardly extending ridges (not illustrated) located on the inner surfaces of base 11. Clips 19A and 19B are strengthened by fin 17B, the ends of which are fused to the abutting surfaces of clips 19A and 19B.

Extending outwardly from the center of base 15 are two parallelly arranged longitudinal rails 21A and 21B. These rails are flat perpendicular projections each having the general shape of a right triangle, one side of which is fused to the upper surface of cover 15, and the hypotenuse serving as a ramp for the support and alignment of the cylindrical chamber 12 and also as a guide for chamber 12 during its installation in base 11. As shown more clearly in FIG. 4, rails 21A and 21B in cooperation with opening 14 hold chamber 12 in an inclined position within base 11.

Located at the lower end of the ramp formed by rails 21A and 21B is a clip 22 having its main planar surface in alignment with the sloping surfaces of rails 21A and 21B and having at its upper extremity a perpendicularly extending ridge 23. Ridge 23 extends in the direction of rails 21A and 21B. The main planar surface of clip 22 is displaced from the slopiing surfaces 21A and 21B by approximately one quarter inch. The lower extremity of clip 22 is fused to the inner surface of cover 15. Two stiffening fins 24A and 24B, one at each edge of clip 22, serve to strengthen and support clip 22 from cover 15. A third and parallel fin 25 gives additional support in its position along the center of clip 22 and, at the same time, serves as a stop or support for the base of chamber 12, the upper edge 26 of fin 25 being perpendicularly oriented with respect to the sloping surfaces of rails 21A and 21B.

Seven positioning tabs 27 in the form of flat perpendicular projections appropriately located about the inside periphery of cover 15 serve to position cover 15 as it is secured to base 11 by clips 19A and 19B.

Key-hole shaped apertures 28 are located in cover 15 one located near its front and one near its rear, as shown, for removably securing cover 15 to a vertical or horizontal surface by means of screws or the like.

Chamber 12 is in the form of a hollow cylindrical body closed at one end by a circular plate 12A and opening at the other end into a spool shaped cavity 12B. As shown more clearly in FIG. 5, cavity 12B is not quite symmetrical with its right hand edge 29 being cut back to provide clearance for the motor housing of an electric hair dryer.

Figure 2:
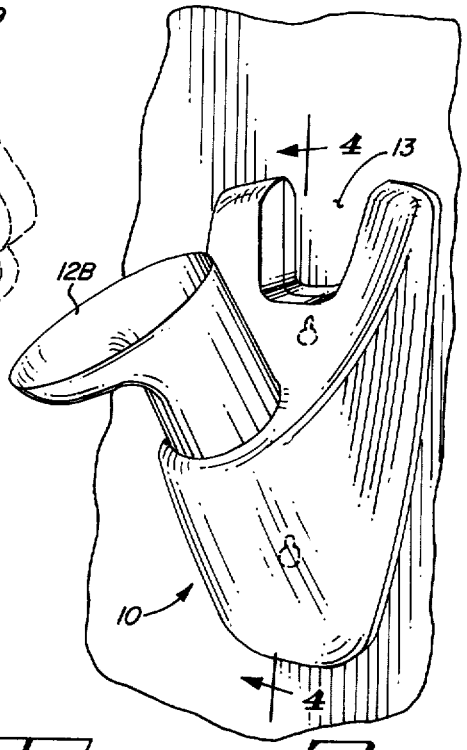
FIG. 2 is a perspective view of the same cradle mounted on a vertical surface and adjusted to give optimum service in the vertical position.
Figure 3:
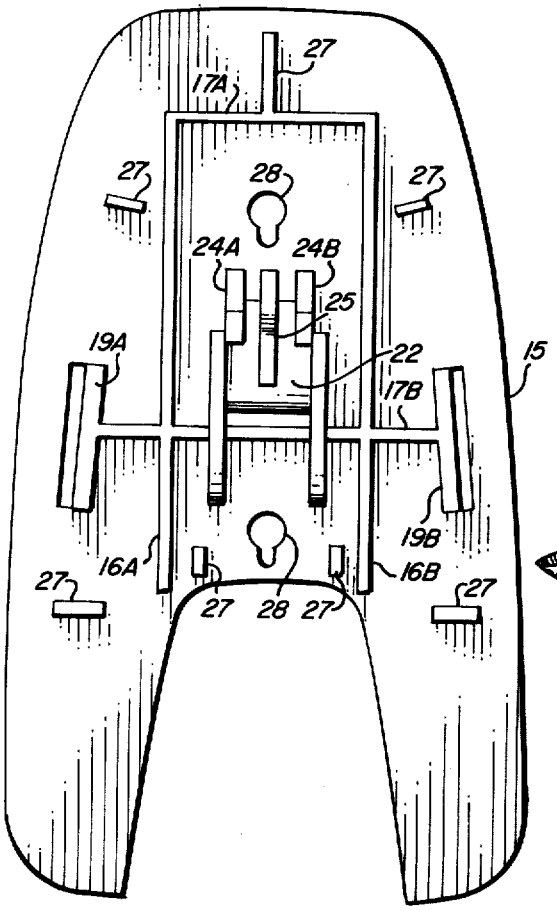
FIG. 3 is a view of the base or mounting place of the cradle taken in the direction of the arrows 3—3 in FIG. 1.
Figure 4:
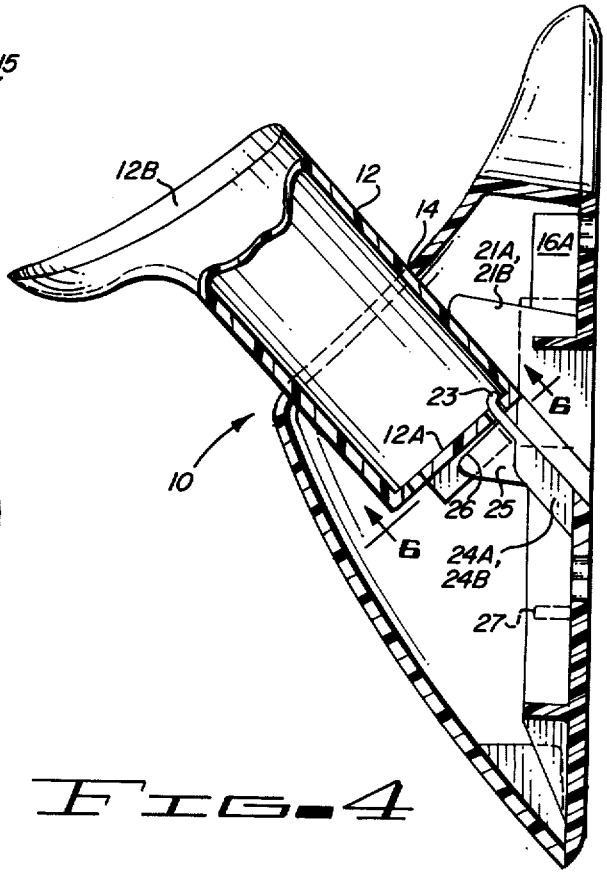
FIG. 4 is a cross-sectional view of the cradle taken along line 4—4 of FIG. 2.
Figure 5:
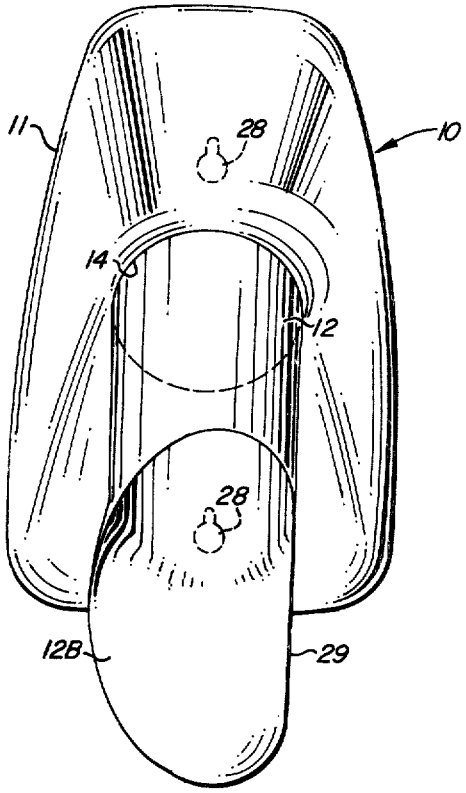
FIG. 5 is a top view of the cradle adjusted for horizontal mounting as shown in FIG. 1.
Figure 6:
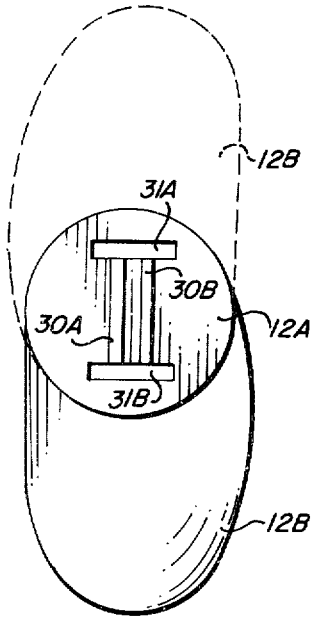
FIG. 6 is a bottom end view of the rotatable cylindrical chamber which holds the electric hair dryer, the chamber being viewed along line 6—6 of FIG. 4.

The illustrations of FIGS. 1, 2 and 4 showing cradle 10 positioned for horizontal and vertical mounting, reveals that chamber 12 is rotated about its axis 180° to convert from horizontal to vertical service. Chamber 12 is equipped with two parallel slots 31A and 31B formed in its end plate 12A, as shown in FIG. 6, which permit the installation of chamber 12 in either of these two positions. Slot 31A accepts the end of clip 22 in one position and slot 31B accepts the end of clip 22 in the other position. FIG. 6 shows chamber 12 in each of these two positions, the dash line image being rotated 180 degrees from the full line image.

Two parallel ridges or fins 30A and 30B running perpendicularly to slots 31A and 31B and located therebetween on the outer lower surface of plate 12A serve to stiffen plate 12A and at the same time to aid in the rotational alignment of chamber 12 by forming between them a groove which accepts the upper edge 26 of fin 25. Chamber 12 is installed within base 11 simply by first aligning slot 31A or 31B with clip 22 and then applying a slight pressure which causes clip 22 to deflect and then return to a gripping position as ridge 23 clears slot 31A or 31B. Pulling chamber 12 outward again produces the necessary deflection of clip 22 to allow removal of chamber 12.

Figure 7:
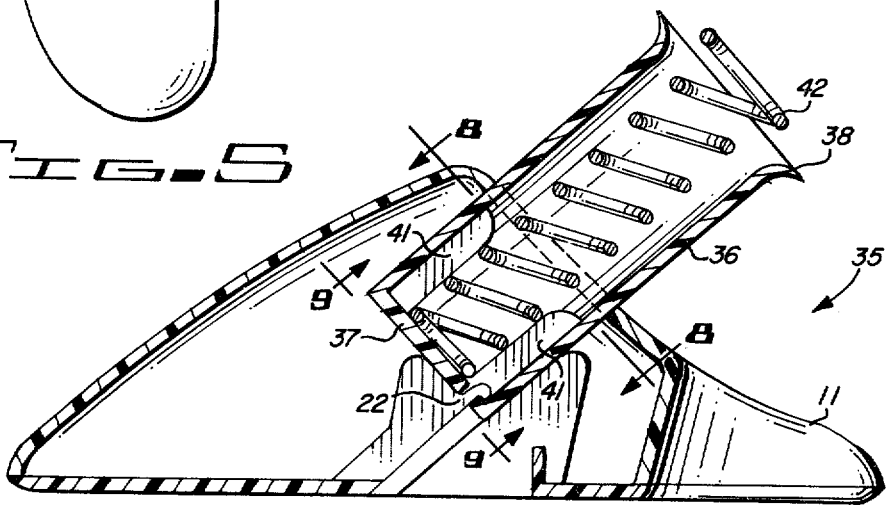
FIG. 7 is a cross-sectional side view of the cradle adapted for holding a hot curling iron, the adaptation having been accomplished through the substitution of a modified cylindrical chamber.
Figure 8:
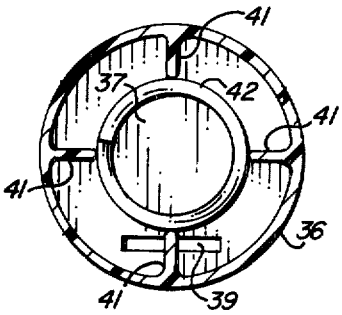
FIG. 8 is a cross-sectional end view of the modified cylindrical chamber of FIG. 7 as viewed along line 8—8 of FIG. 7.
Figure 9:
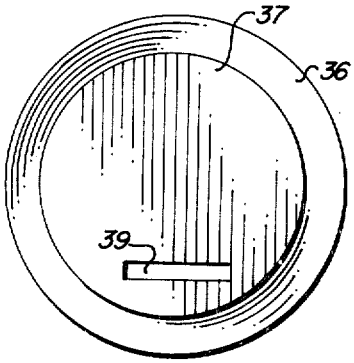
FIG. 9 is a bottom end view of the modified cylindrical chamber of FIG. 7 as viewed along line 9—9 of FIG. 7.

FIGS. 7, 8 and 9 illustrate a modification of cradle 10 in which a cradle 35 is provided for holding a hot curling iron or similar appliance, the modification entailing the substitution of a different chamber 36 for chamber 12 of cradle 10. The base 11 of cradle 35 is idential to base 11 of cradle 10.

Chamber 36 comprises a cylindrical body closed at one end by a circular plate 37 and open at one end with the opening having a slightly flared tapered end 38.

Plate 37 has a single slot 39 for receiving clip 22. Four ribs 41 are arranged to extend radially inward from the inside surface of chamber 36 approximately one half of an inch running from plate 37 to a point about one third the way toward end 38. These ribs provide a snug supporting structure for a coiled metal spring 42 arranged with chamber 36, as shown. The ribs are equally spaced to define quadrants about the circular cross-section of chamber 36 for holding spring 42 concentrically within the chamber. It is thus possible to insert the hot tip of a curling iron inside spring 42 with spring 42 supporting the hot iron and preventing physical contact between the iron and the plastic surface of chamber 36.

It will be appreciated that in a commercial offering, both chambers 12 and 36 may be supplied with one installation so that the assembly can serve for either a hair dryer or hot iron support.

All of the parts described are readily fabricated by inexpensive molding processes from appropriate plastic materials and thus may be marketed at low cost for wide use in accordance with the objects of the invention.

Although only two embodiments of the invention have been illustrated and described, it will be apparent to those skilled in the art that various changes and modifications may be made therein without departing from the spirit of the invention or from the scope of the appended claims.

What is claimed is:

1. A cradle for supporting a hand held beauty appliance comprising in combination:

a supporting base, a contoured hollow housing for mounting on said base and defining an aperture extending through its surface for detachably receiving a cylindrically shaped chamber in a sliding fitting arrangement therein, a cylindrically shaped chamber slidingly fitted into said aperture of said housing, means mounted on said chamber for interconnecting said chamber at one end thereof with said base for controlling the positioning of said chamber in said housing, said chamber being formed to receive and support therein a hand held beauty appliance, said means for interconnecting said chamber at one end thereof with said base comprising an apertured plate mounted at said one end of said chamber, and a protrusion mounted on said base, said protrusion penetrating said apertured plate in one of two inserted positions of said chamber in said aperture of said housing for detachably interconnecting said chamber with said base.

2. The cradle set forth in claim 1 wherein:

the other end of said chamber is distorted to fit around the contoured housing of the nozzle of a hair dryer.

3. The cradle set forth in claim 1 wherein:

the other end of said chamber is distorted to receive in supporting arrangement the housing of the motor of a hair dryer.

4. The cradle set forth in claim 1 wherein:

said aperture is formed in said housing to hold said chamber laterally of the surface of said base.

5. The cradle set forth in claim 1 in further combination with:

a spring mounted in said one end of said chamber for supporting in axial alignment with and spaced from the inside surface of said chamber the wand of a curling iron.

* * * * *